United States Patent [19]

Klemm

[11] Patent Number: 4,998,470

[45] Date of Patent: Mar. 12, 1991

[54] SCREEN PRINTING MACHINE HAVING AN INCLINED SCREEN

[76] Inventor: Gerhard Klemm, Am Rehwinkel 37, D-4800 Bielefeld 1, Fed. Rep. of Germany

[21] Appl. No.: 463,878

[22] Filed: Jan. 5, 1990

Related U.S. Application Data

[63] Continuation of Ser. No. 203,357, Jun. 6, 1988.

[30] Foreign Application Priority Data

Jun. 6, 1987 [DE] Fed. Rep. of Germany ..... 3719059

[51] Int. Cl.[5] ..... B41F 15/10; B41F 15/40; B41F 15/36

[52] U.S. Cl. ..... 101/115; 101/124

[58] Field of Search ..... 101/116, 117, 118, 124, 101/126

[56] References Cited

U.S. PATENT DOCUMENTS

| | | | |
|---|---|---|---|
| 562,898 | 6/1896 | Jofeh | 101/124 |
| 1,832,216 | 11/1931 | Johnston et al. | 101/124 |
| 2,375,237 | 5/1945 | Morgan et al. | 101/126 |
| 2,555,096 | 5/1951 | Reinke | 101/124 |
| 3,229,627 | 1/1966 | Pollitt | 101/124 X |
| 3,252,411 | 5/1966 | Black | 101/124 |
| 3,880,076 | 4/1975 | Black et al. | 101/124 X |
| 4,510,864 | 4/1985 | Klemm | 101/123 |
| 4,577,559 | 3/1986 | Burger | 101/228 X |
| 4,628,620 | 12/1986 | Klemm | 34/236 |
| 4,628,814 | 12/1986 | Klemm | 101/126 X |

FOREIGN PATENT DOCUMENTS

| | | | |
|---|---|---|---|
| 192373 | 10/1957 | Austria . | |
| 2548652 | 5/1976 | Fed. Rep. of Germany | 101/126 |
| 3306241 | 8/1984 | Fed. Rep. of Germany | 101/124 |
| 184544 | 7/1982 | Japan . | |
| 13566 | of 1894 | United Kingdom | 101/124 |
| 671974 | 5/1952 | United Kingdom | 101/124 |

*Primary Examiner*—Clifford D. Crowder
*Attorney, Agent, or Firm*—Peter K. Kontler

[57] ABSTRACT

A screen printing machine with at least one screen printing unit having a flat screen which is inclined relative to the horizontal so as to reduce the floor space requirements and is reciprocable up and down by a rack and pinion drive. A drying arrangement for the webs or sheets which are treated in the machine is disposed at a level below the screen, and each unit has a platform which is adjacent a web- or sheet-supporting cylinder to facilitate immediate inspection of the web or sheets downstream of the printing station between the screen and the cylinder. The latter is indexible about a fixed axis.

22 Claims, 5 Drawing Sheets

SCREEN PRINTING MACHINE HAVING AN INCLINED SCREEN

This application is a continuation of application Ser. No. 203,357, filed June 6, 1988.

BACKGROUND OF THE INVENTION

The invention relates to screens in printing machines in general, and more particularly to improvements in screen printing machines with reciprocable screens. Still more particularly, the invention relates to improvements in screen printing machines of the type wherein a screen is reciprocable at one side of the path for a web or sheet of material to be treated opposite a sheet- or web-supporting cylinder.

German Offenlegungsschrift No. 2 332 534 of Brasa discloses a printing machine wherein a flat screen is reciprocable in a horizontal plane at a level above the path for an intermittently transported web of paper or the like and opposite a rotary web-supporting cylinder. The latter further serves as a means for intermittently advancing the web along its path. A drawback of the screen printing machine of Brasa is that its space requirements are excessive, especially if the machine comprises two or more screen printing units each with a horizontal screen which is reciprocable in its plane between a foremost and a rearmost position. Each screen reciprocates relative to a discrete stationary cylinder. Since the machine of Brasa is designed for multicolor screen printing, it must comprise at least two discrete screens and an equal number of cylinders. The screens cannot be placed close to each other because there must remain ample room for reciprocatory movements of screens in and counter to the direction of advancement of the web through successive screen printing units.

U.S. Pat. No. 3,252,411 to Black discloses a screen printing machine which applies ink, adhesive or other coating materials to intermittently advance paper sheets. The space requirements of the machine of Black are just as unsatisfactory as those of the machine of Brasa because the machine of Black also employs one or more flat screens which must reciprocate in horizontal planes. As a rule, the space requirements of each screen printing unit correspond to twice the length of its reciprocable horizontal screen. Furthermore, neighboring screen printing units are normally separated by drying means which also occupy substantial amounts of space.

German Pat. No. 23 26 371 to Dubuit discloses a machine which is used to apply printed matter to or to otherwise coat bottles, tubes, pipes or other hollow objects which are rotatably mounted on mandrels indexible by a disc along an endless path and past two successive screen printing units employing mutually inclined screens. The machine of Dubuit is not suitable for screen printing of continuous webs or sheets of paper or the like. Moreover, the space requirements of the machine of Dubuit are enormous because the disc carries a complete annulus of mandrels which are to support a large number of hollow objects. Still further, the versatility of the patented machine is unsatisfactory because the two screens are invariably compelled to move in synchronism.

Austrian Pat. No. 192373 to Hediger discloses a screen printing machine with an inclined screen which is pivotable about a fixed horizontal axis.

Japanese patent application Ser. No. 55-184544 of Kagai discloses an ink applicator for use in a screen printing machine. The applicator employs a first pump which delivers ink to a screen adjacent a doctor and draws non-applied ink from a reservoir adjacent a second pump. The screen printing machine of Kagai operates with a horizontal screen.

Further screen printing machines with horizontal screens are disclosed in commonly owned German Offenlegungsschrift No. 31 36 175 and in commonly owned U.S. Pat. Nos. 4,510,864, 4,589,336 and 4,628,814.

Apparatus for drying webs in a screen printing machine are disclosed in commonly owned U.S. Pat. Nos. 4,619,050 and 4,628,620, and commonly owned U.S. Pat. No. 4,249,688 discloses a device for intermittent feeding of webs in screen printing machines.

A drawback which is common to all screen printing machines known to applicant at this time, especially to those screen printing machines wherein the web is transported from a supply reel to a takeup reel, is that it is not possible to readily monitor the quality of freshly applied printed matter. This is particularly disadvantageous in multicolor printing machines. The reciprocating horizontal screens or stationary horizontal screens of such machines obstruct the actual printing station or stations so that it is possible to monitor only the quality of those increments of a running web which leave the single screen printing unit or the last screen printing unit of the machine. This often necessitates discarding of considerable lengths of treated material because of improper application (absence of accurate register) of different types of printing media on top of or next to each other and/or because the application of one or more coats of printing media to certain portions of the web is less satisfactory than to others.

OBJECTS AND SUMMARY OF THE INVENTION

An object of the invention is to provide a novel and improved screen printing machine whose floor space requirements are a minute fraction of the floor space requirements of conventional machines.

Another object of the invention is to provide a machine wherein the treated material is always accessible for immediate inspection of its condition upon the application of one or more layers of coating medium or media thereto.

A further object of the invention is to provide a screen printing machine wherein the screen or screens are adjustable in a novel and improved way.

An additional object of the invention is to provide the screen printing machine with novel applicator means for the medium or media to be applied to webs or sheets of paper or the like.

Still another object of the invention is to provide a machine wherein the means for drying the webs or sheets are positioned in a novel and improved way so as not to contribute to floor space requirements of the machine.

A further object of the invention is to provide the machine with novel and improved means for maintaining its screen or screens in an optimum orientation and with novel and improved means for moving the screen or screens relative to the machine frame.

An additional object of the invention is to provide a novel and improved method of reducing the floor space requirements of the unit or units of a screen knitting machine.

Another object of the invention is to provide a novel and improved frame for the screen of a screen printing machine.

A further object of the invention is to provide one or more novel and improved combinations of screen and drying means in a machine of the above outlined character.

The invention is embodied in a screen printing machine for the treatment of webs or sheets of paper or the like which are advanced (either continuously or stepwise) in a predetermined direction along a predetermined elongated path. The machine comprises at least one screen printing unit including a reciprocable flat screen at one side of a predetermined portion of the path, means for maintaining the screen in a plane which is inclined relative to the horizontal, means for moving the screen forwardly in and rearwardly counter to the predetermined direction, a web- or sheet-supporting cylinder which is rotatable about a fixed axis and is disposed at the other side of the predetermined portion of the path, and applicator means including a squeegee or other suitable means for inducing the flow of ink or another printing or coating medium (hereinafter called printing medium) through the screen and into contact with the web or sheet in the predetermined portion of the path. The moving means can include a carriage for the screen. For example, the screen can include a stencil and a frame which surrounds the stencil and is removably mounted in the carriage. Such moving means further comprises drive means for reciprocating the carriage relative to the cylinder and relative to the flow-inducing means of the applicator means.

The means for maintaining the screen in inclined position relative to the horizontal is preferably designed to change the inclination of the screen relative to the horizontal. The inclination of the screen relative to the horizontal can be anywhere between 5–85 degrees. It is presently preferred to select an angle of 50–70 degrees, most preferably an angle of or close to 60 degrees.

The screen is movable relative to the cylinder and the flow-inducing means between an upper end position and a lower end position, and the flow-inducing means is preferably operative during movement of the screen from the lower toward the upper end position. The flow-inducing means of the applicator means is located opposite the cylinder, and the screen is located between the cylinder and the flow-inducing means. The applicator means can further comprise a source of printing medium (e.g., a pump which circulates the printing medium) means for conveying printing medium from the source to the screen in the region of the flow-inducing means, and means for returning non-applied printing medium from the screen to the source for recirculation into the conveying means.

It is presently preferred to impart to the predetermined portion of the path the shape of a loop having a bight for the cylinder and two substantially vertical legs which flank the bight. In other words, the predetermined portion of the path can be U-shaped. The web or sheet preferably moves upwardly along one of the legs and downwardly along the other of the legs, i.e.. the predetermined portion of the path resembles an inverted U. Such path can further include an upstream portion along which the web or sheet advances toward the one leg and a downstream portion along which the web or sheet advances from the other leg of the U. One of the upstream and downstream portions can overlie the other of these portions; e.g., successive increments of the web or sheet can change the direction of their movement on entry into the downstream portion so that they move counter to the direction of advancement of the web or sheet along the upstream portion.

The cylinder is preferably hollow and can comprise a foraminous cylindrical shell and a suction chamber inwardly adjacent the shell opposite the flow-inducing means.

The machine can further comprise a platform (e.g., a bridge or a stool) which is adjacent one leg of the U-shaped portion of the path and extends transversely of the path. Such platform facilitates inspection of the region of the cylinder and other parts of the machine by enabling an operator standing on or otherwise occupying the platform to gain access to the cylinder and to other parts.

The machine or each of its units includes a frame for the cylinder and for the maintaining means, and the maintaining means can include one or more guide rails on the frame. Means can be provided for adjustably affixing the guide rail to the machine frame. The moving means can include at least one toothed rack at the underside of the screen (e.g.. in or on the frame for the stencil). and a driven pinion which is mounted in or on the machine frame and mates with the rack. The unit can further comprise means for adjustably mounting the pinion and its motor in the machine frame.

In a presently preferred embodiment of a screen printing unit, the applicator means comprises a pump having an inlet and an outlet for the printing medium a squeegee which includes, constitutes or forms part of the flow-inducing means and is adjacent the screen opposite the cylinder, first conduit means for conveying printing medium from the outlet of the pump to the screen adjacent the squeegee so that the latter can apply some of the printing medium to the web or sheet by causing the printing medium to pass through the screen in response to movement of the screen relative to the cylinder and relative to the squeegee, and flexible second conduit means for returning non-applied printing medium from the screen to the inlet of the pump. The second conduit means preferably comprises an intake for printing medium, and such intake is preferably adjacent the lower portion of the screen and shares the movements of the screen relative to the cylinder and the squeegee.

The means for maintaining the screen in a position of inclination relative to the horizontal can include at least one grooved guide rail which is provided directly on the screen; for example, such grooved guide rail or guide rails can be rigid with the aforementioned frame which surrounds the stencil of the screen.

The lower portion of the frame for the stencil can include a plurality of mutually inclined sections (e.g.. such lower portion of the frame for the stencil can resemble the letter V) which define a pocket for collection of non-applied printing medium. The aforementioned second conduit means of the applicator means in a screen printing unit which employs such screen can be said to constitute an evacuating conduit whose intake is positioned to receive printing medium from the pocket.

The applicator means preferably further comprises a flood bar at a level below the squeegee, and the first conduit means of the applicator means then preferably delivers printing medium from the outlet of the pump to the screen between the squeegee and the flood bar.

The screen printing unit can further comprise means for drying the web in a further portion of the path upstream or downstream of the predetermined portion and preferably at a level below the predetermined portion. The drying means can comprise a plurality of different dryers; for example, such drying means can comprise a contact dryer at one side of the further portion of the path and a pneumatic dryer at the other side of the further portion of the path. The contact dryer can actually contact the uncoated side of the web or sheet, and the pneumatic dryer can be designed to blow one or more jets of hot air or another suitable gaseous fluid against the coated side of the web or sheet.

The improved machine can comprise at least one second screen printing unit which is adjacent a second portion of the path upstream or downstream of the predetermined portion. The screen printing units are preferably spaced apart from each other in the predetermined direction so as to provide between them room for inspection of the sheet or web and/or of various component parts of the machine. The latter can comprise means for changing the inclination of the screen relative to the horizontal in each of the units. A multiple-unit machine can further comprise means for centering the web or sheet with reference to the cylinder of at least one of the units, and the centering means can be adjacent a third portion of the path intermediate the predetermined and second portions. Such machine can further comprise means for tensioning the web or sheet in or adjacent the third portion of the path. Still further, the machine with two or more screen printing units can include a device which monitors the tension of the web or sheet between the predetermined and second portions of the path and can serve to regulate the tensioning means. If the machine comprises two or more screen printing units, the screen in each such unit may but need not be inclined relative to the horizontal.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
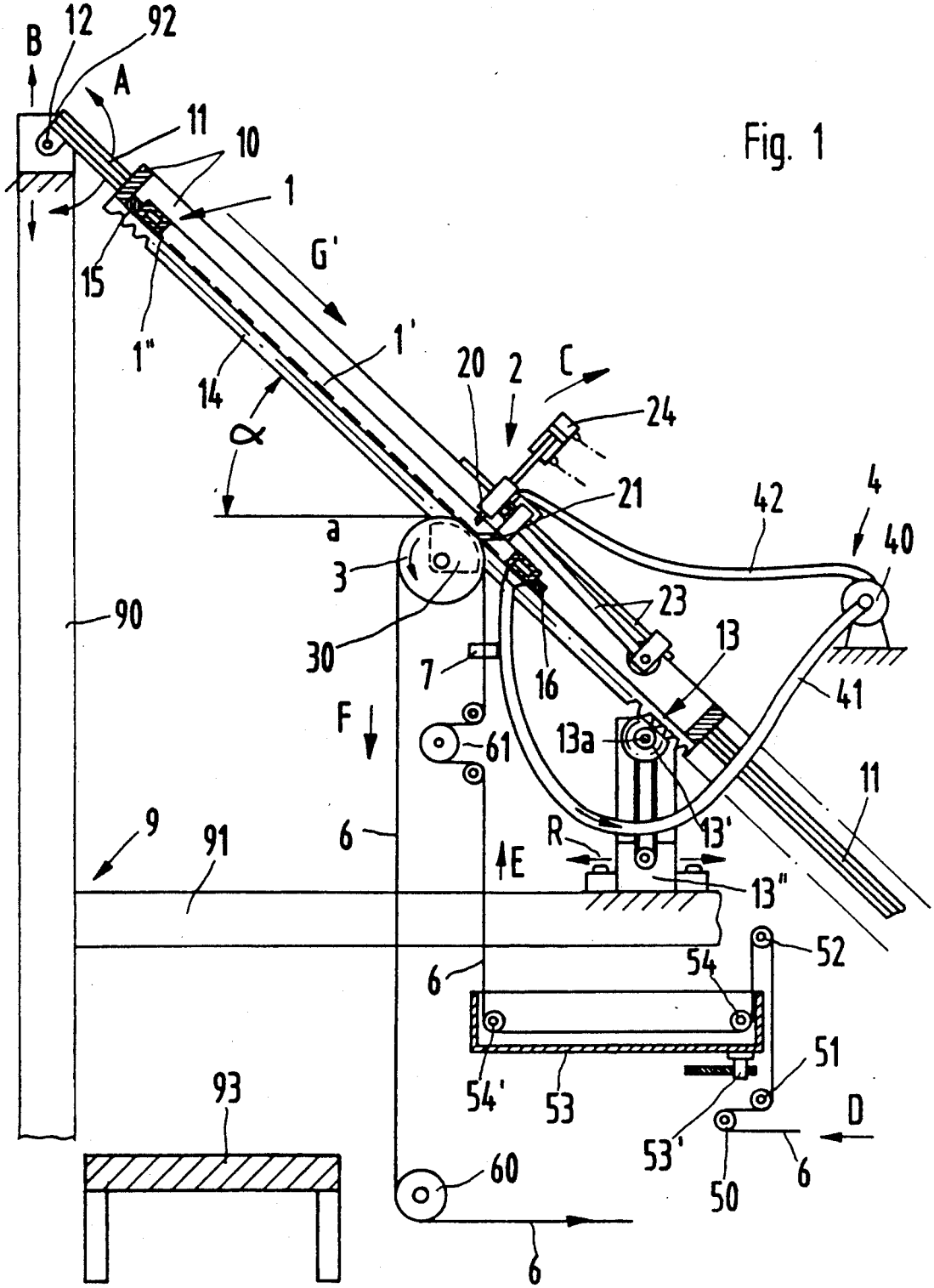
FIG. 1 is a partly elevational and partly vertical sectional view of one unit of a screen printing machine which embodies the invention, the screen being shown in its upper end position.
Figure 2:
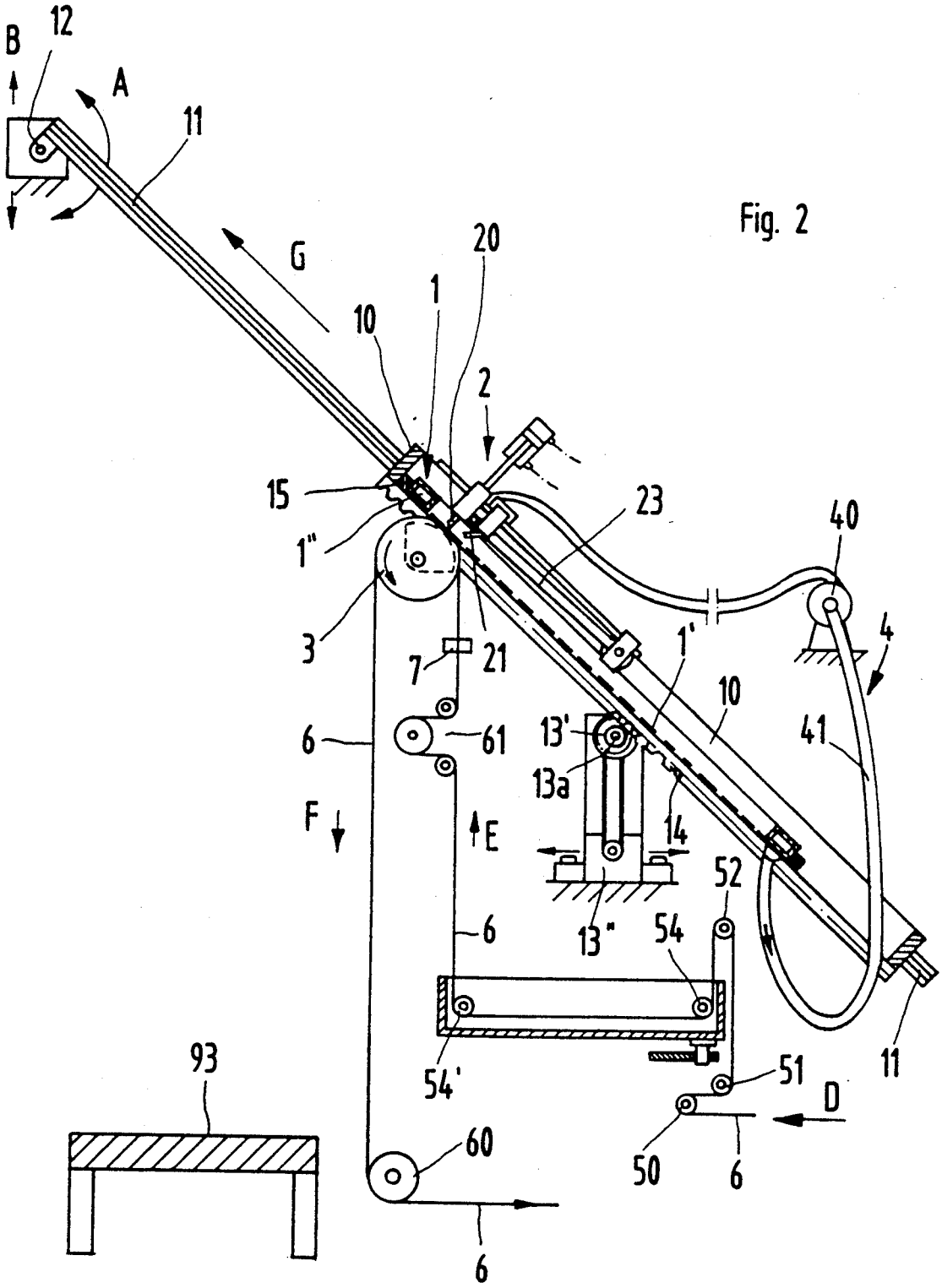
FIG. 2 is a similar view but showing the screen in the lower end position.
Figure 3:
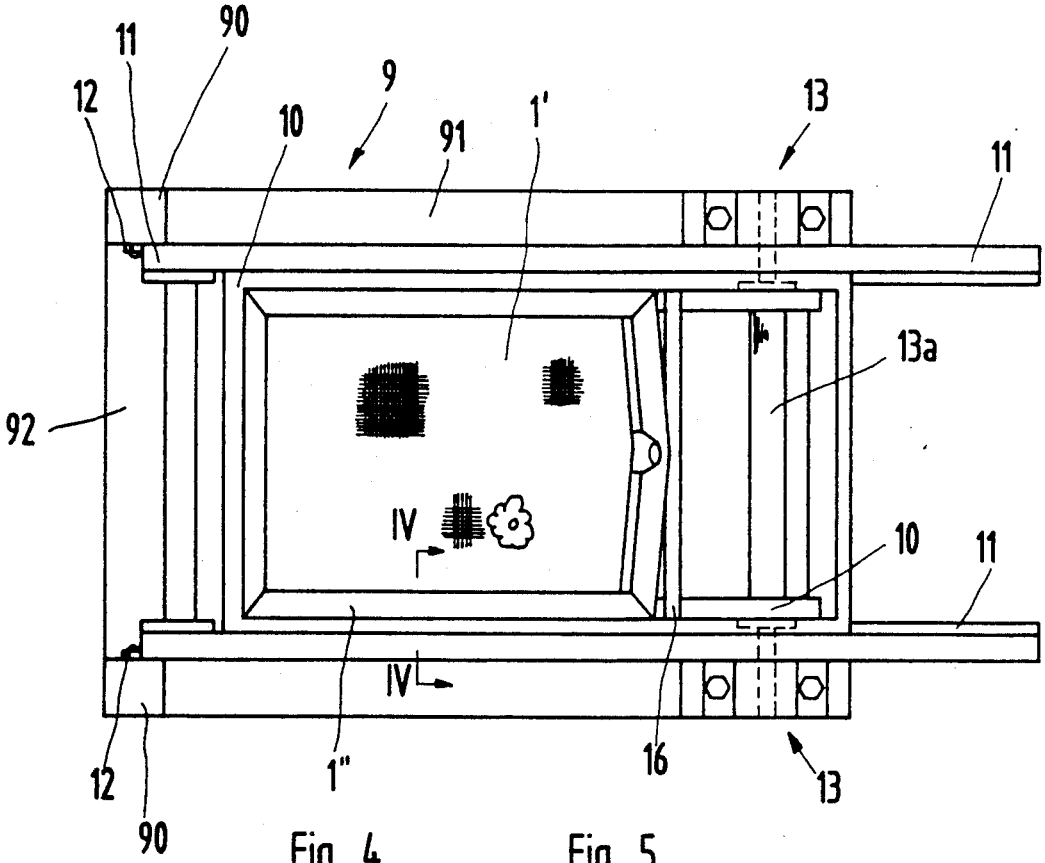
FIG. 3 is a plan view of a portion of the unit which is shown in FIGS. 1 and 2.
Figure 4:
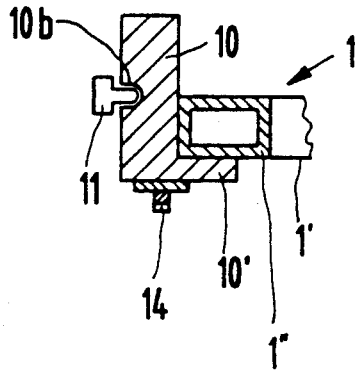
FIG. 4 is an enlarged fragmentary sectional view as seen in the direction of arrows from the line IV—IV in FIG. 3.

Referring first to FIGS. 1 to 3, there is shown a screen printing unit which can form part of a multicolor screen printing machine with two or more units. The illustrated unit comprises a substantially rectangular flat screen 1 which is removably installed in a carriage 10. The means for maintaining the screen 1 and the carriage 10 at a selected angle alpha to a horizontal plane a includes elongated guide rails 11 which are mounted in the frame 9 of the screen printing machine and can be caused to change their inclination by moving their upper ends in directions indicated by a double-headed arrow A. As can be seen in FIG. 4, the longitudinally extending (inclined) portions of the carriage 10 have grooves **10*b* for portions of the respective guide rails 11. Each of the guide rails 11 can have a substantially T-shaped cross-sectional outline. The aligned pivot members which define a common horizontal axis for pivotal movement of the upper ends of the guide rails 11 are shown in FIG. 3, as at 12. The inclination of the guide rails 11, and hence of the carriage 10 and screen 1 with reference to a horizontal plane, can be altered by causing the pivot members 12 to move up or down as indicated in FIGS. 1 and 2** by arrows B.

The means 13 for moving the carriage 10 and the screen 1 along a sloping path whose inclination relative to the horizontal plane a is determined by the selected inclination of the guide rails 11 comprises a pinion 13' for each of the guide rails 11 and a toothed rack 14 for each of the pinions 13'. The racks 14 are mounted at the underside of or are integral with the carriage 10 adjacent the respective guide rails 11.

The pinions 13' for the two toothed racks 14 are mounted on a common horizontal shaft **13*a* (see particularly FIG. 3) which can be driven by a reversible electric or other suitable motor 13''. The entire motor 13'' is shiftable in the machine frame in directions which are indicated by a double-headed arrow R (note FIG. 1). This enables the pinions 13' to remain in mesh with the respective toothed racks 14 even if the inclination of the guide rails 11** is changed.

The reference characters 15, 16 denote two strips which are inserted between the frame 1'' for the stencil 1' of the screen 1 and the carriage 10 in order to ensure that the frame 1 is in an optimum position with reference to a hollow sheet- or web-supporting cylinder 3 which is rotatable in the machine frame about a fixed horizontal axis at a level below the path of movement of a web 6 of paper or the like which is to be treated in the screen printing unit of FIGS. 1 to 3.

The cylinder 3 has a foraminous cylindrical shell and a stationary suction chamber 30 installed in the interior and adjacent that portion of the shell which is nearest the adjacent predetermined portion of the path for the web 2. Such portion of the shell of the cylinder 3 is located opposite an applicator 2 having a squeegee 20 serving to induce the flow of a printing medium through the stencil 1' of the screen 1 and into contact with the adjacent portion of the web 6. The applicator 2 further comprises a so-called flood bar 21 which is located at a level below the squeegee 20 and serves to move a pool of printing medium toward the lower portion of the frame 1'' while the screen 1 and the carriage 10 are caused to move upwardly from the positions of FIG. 2 toward those which are shown in FIG. 1.

A linkage 23 is provided on the machine frame 9 to permit adjustment of the squeegee 20 and flood bar 21 relative to the carriage 10 and the screen 1 therein. For example, the linkage 23 enables the operator to lift the squeegee 20 and the flood bar 21 off the screen 1 in the direction of arrow C as well as to move the flood bar and the squeegee relative to or jointly with each other in parallelism with the stencil 1' of the screen 1 (i.e., relative to the cylinder 3). When the screen printing unit of FIGS. 1 to 3 is in use, the position of the applicator 2 is normally selected in such a way that the tip of the squeegee 20 is adjacent the line where the stencil 1' of the screen 1 is nearest to the peripheral surface of the foraminous cylindrical shell of the cylinder 3.

The applicator 2 further comprises a medium feeding means 4 having a source 40 of printing medium which is a circulating pump with an outlet connected to a first flexible conduit 42 serving as a means for conveying printing medium to the stencil 1' of the screen 1 between the squeegee 20 and the flood bar 21. A second flexible conduit 41 connects the inlet of the pump 40 with the space at the lower end of the frame 1'' of the screen 1 so that the intake of the conduit 41 can draw the non-applied printing medium back into the pump 40. The intake of the conduit 41 can be affixed to the frame 1'' so as to ensure that it is invariably maintained in an optimum position for evacuation of non-applied printing medium.

The means for defining a predetermined elongated path for the web 6 includes the aforementioned sheet- or web-supporting cylinder 3 as well as a number of pulleys, rolls and other parts. The web 6 is drawn off a supply reel (not specifically shown) and advances in the direction of arrow D first over pulleys 50, 51 and 52 prior to reaching a centering or orienting device 53 which is pivotable about the axis of a vertical shaft 53' mounted in the machine frame. The centering device 53 carries pulleys 54, 54' over which the web 6 is trained on its way toward the aforesaid predetermined portion of the path. Such portion of the path resembles an inverted letter U and has at its top a bight for the shell of the cylinder 3 as well as two parallel substantially vertical legs which flank the bight for the cylinder 3. The web 6 advances in the direction of arrow E during movement along the right-hand leg of the inverted U-shaped portion of the path, and the web 6 moves in the direction of arrow F during travel along the left-hand leg of such path portion.

The exact details of the centering device 53 form no part of the present invention. Such centering devices are known, for example, from the aforementioned commonly owned U.S. patents to Klemm. The purpose of the centering device 53 is to ensure that the web 6 is properly guided over the cylinder 3, i.e., that its marginal portions are located at a proper distance from the respective axial ends of the cylinder.

A combined tension monitoring and adjusting device 61 including three pulleys and an adjuster 7 is adjacent the right-hand leg of the inverted U-shaped portion of the path for the web 6 and serves to ensure that the web is under adequate tension during travel over the cylinder 3. The web 6 thereupon advances over a pulley 60 and enters a drying means 8 (see FIG. 6) on its way into the next screen printing unit or to the takeup reel.

A platform 93 in the form of a bridge or stool which extends transversely of the path of movement of the web 6 is adjacent that leg of the inverted U-shaped portion of the path where the web 6 is trained over the pulley 60. The platform 93 enables an operator to reach the cylinder 3 and/or other portions of the screen printing unit in the region of the printing station.

The two legs of the inverted U-shaped portion of the path for the web 6 are preferably, but need not be, exactly vertical and parallel to each other. For example, the two legs of such path portion can make a relatively small acute angle without unduly increasing the dimensions of the screen printing unit. It will be noted that the screen printing unit of FIGS. 1 to 3 is relatively narrow but also relatively tall; this is attributable to the fact that the screen 1 is inclined relative to the horizontal plane a so that the floor space requirements of the screen printing unit can be reduced to a relatively small or very small fraction of the floor space requirements of a conventional screen printing unit wherein the screen is reciprocable in a horizontal plane. The person occupying the platform 93 can observe the quality of printed matter or coating which is applied to the web 6 in the region of the cylinder 3 as well as whether or not the printed matter or coat has been properly centered between the marginal portions of the web. Moreover, the operator can ascertain whether or not the raster dots are properly applied. The operator can immediately reset the cylinder 24 for the squeegee 20 and/or undertake other remedial measures if the inspection reveals that the coating or printing of the web 6 is unsatisfactory. Furthermore, the operator can change the orientation of the web 6 relative to the cylinder 3, change the rate of delivery of printing medium by the feeding means 4 or shut down the entire machine if an inspection of the quality of the treated web 6 in the region of the cylinder 3 warrants such remedial undertakings.

The squeegee 20 constitutes but one of numerous flow-inducing means which can be used in the applicator 2 to provide selected portions of or the entire web 6 with ink, adhesive or other coating material. For example, the illustrated blade-like squeegee 20 can be replaced with a roller or with one or more spray nozzles which discharge atomized ink, adhesive or the like over the entire area of the web 6 or over those portions of the web which are adjacent the permeable portion or portions of the stencil 1'. Suitable coats of ink or other material can be applied to produce a glazing or other desirable effect.

The angle alpha which is shown in FIG. 1 approximates 43 degrees. This angle can be reduced to 5 degrees or increased to 85 degrees. A presently preferred angle is between 50 and 70 degrees, most preferably at or close to 60 degrees. The inclination of the squeegee 20 is preferably changed in response to any and all appreciable changes of the angle alpha so that the squeegee 20 (which is assumed to constitute or resemble a doctor blade) normally extends close to or exactly radially of the cylinder 3, i.e., that the squeegee is disposed at right angles to the stencil 1'.

FIG. 1 shows that the stage of operation of the illustrated screen printing unit when the flood bar 21 engages the pool of printing medium at a predetermined distance from the upper side of the stencil 1' so that the latter receives a coat of predetermined thickness as the motor 13'' causes the pinions 13' to move the carriage 10 and the screen 1 downwardly (note the arrow G').

FIG. 2 shows the start of the so-called pressure stage or phase. The squeegee 20 has been moved downwardly by the piston in the cylinder in the fluid-operated motor 24 and the flood bar 21 has been simultaneously lifted so that it is located at a greater distance from the adjacent side of the stencil 1'. The squeegee 20 causes the printing medium to form a pool which extends transversely across the entire stencil 1' while the motor 13" causes the carriage 10 to move the screen 1 in the direction of the arrow G. At such time, the cylinder 3 rotates in a counterclockwise direction (this cylinder is preferably mounted on a freewheel so that it cannot turn in the clockwise direction while the carriage 10 and the stencil 1 thereupon move downwardly back to the positions of FIG. 1). The web 6 advances in the directions which are indicated by the arrows D, E and F. The web 6 is idle, the same as the cylinder 3, while the carriage 10 and the screen 1 move (arrow G') from the positions of FIG. 1 to those which are shown in FIG. 2. At such time, the cylinder 3 is out of contact with the underside of the web 6. This cannot be seen in FIG. 1 because the width of the gap between the cylinder 3 (at or close to the 1½ o'clock position) and the underside of the web 6 is minimal. The web 6 is also out of contact with the stencil 1' of the screen 1, and the stencil 1' is out of contact with the web (in the absence of a web between the cylinder 3 and the stencil 1', e.g., during a test run in the manufacturing or assembly plant, the stencil 1' is out of contact with the cylinder 3 while the carriage 10 is caused to move downwardly as indicated in FIG. 1 by the arrow G').

The reversible motor 13" can change the direction of movement of the carriage 10 and stencil 1 at regular or selected intervals, automatically or in response to manual actuation of the controls for the motor 13". The length of strokes which are performed by the carriage 10 in the directions of arrows G and G' is or can be regulated by indicia on the web 6.

When the screen 1 is in the process of performing its pressure stroke (arrow G in FIG. 2). the squeegee 20 is adjacent the upper side of the upwardly moving screen 1 and causes the aforementioned pool of printing medium to gather along its lower edge (i.e., at that side which faces the flood bar 21). Some of the printing medium which forms the pool passes through the stencil 1' and comes in contact with successive increments of the advancing web 6, and the remainder of the pool remains at the upper side of the stencil and is drawn into the intake of the evacuating conduit 41 because the circulating pump 40 is on. The tendency of the pool to flow toward the intake of the evacuating conduit 41 is enhanced by the inclination of the stencil 1' with reference to the horizontal plane a. The pump 40 forces the returned printing medium to reenter the conduit 42 and to flow back onto the stencil 1' intermediate the squeegee 20 and the flood bar 21. Such recirculating of the printing medium ensures a thorough intermixing of its constituents and reduces the likelihood of aging of printing medium which contacts the stencil 1'. Still further, recirculation reduces the likelihood of deposition of metallic particles in the printing medium upon the stencil 1' and eventual clogging of its apertures. The recirculating action of the pump 40 is assisted by the force of gravity due to inclination of the stencil 1' with respect to horizontal plane a. Since the printing medium at the upper side of the inclined stencil 1' invariably tends to flow downwardly toward the lower portion of the frame 1' of the screen 1, it assists the flood bar 21 in ensuring the establishment of a layer of uniform thickness at the upper side of the stencil 1' to thus enhance the quality of the printing action. Moreover, the printing medium tends to flow toward and into the range of the intake of the evacuating conduit 41 to ensure predictable and thorough intermixing of the constituents of printing medium. It has been found that an inclined stencil is much less likely to be clogged by dried constituents of the printing medium than a horizontal stencil, and the inclined stencil permits a very thorough intermixing of constituents of the printing medium, not only under the action of the pump 40 but also because the printing medium invariably tends to flow along the stencil 1', i.e., the printing medium cannot stagnate at the upper side of the stencil.

Figure 5:
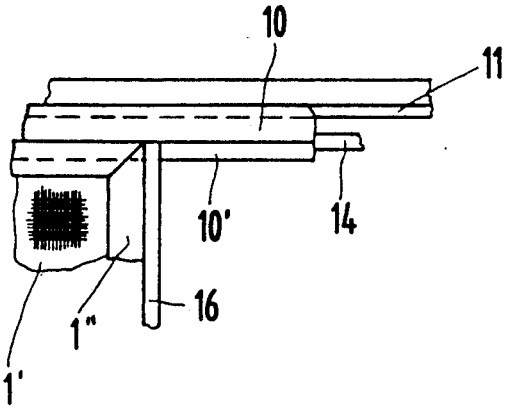
FIG. 5 is a view of a detail in the structure of FIG. 3.

FIGS. 3 to 5 show certain details of the screen printing unit of FIGS. 1 and 2. The machine frame 9 comprises several upright frame members 90 which carry the corresponding pivot members 12 for the upper end portions of the guide rails 11, and one or more horizontal frame members 91 which stiffen the frame 9 and carry the adjustably mounted motor 13" for the pinions 13' of the moving means 13. One or more upper horizontal frame members 92 extend between the upright frame members 90 to contribute to stability of the frame 9. The aforementioned horizontal shaft 13*a* carries the pinions 13' which mate with the respective toothed racks 14 at the underside of the carriage 10.

FIG. 4 shows that the carriage 10 has a ledge 10' which supports the frame 1" of the screen 1 from below. FIG. 4 also shows one of the two grooves 10*b* which are provided in the longitudinally extending (sloping) portions of the carriage 10 to receive portions of the T-shaped guide rails 11.

FIG. 5 shows the strip-shaped. fastener 16 which cooperates with the fastener 15 to properly locate the frame 1" of the screen 1 in the carriage 10. The position of the frame 1" relative to the carriage 10 can be altered by replacing the illustrated fasteners 15, 16 with thicker or thinner fasteners.

Figure 6:
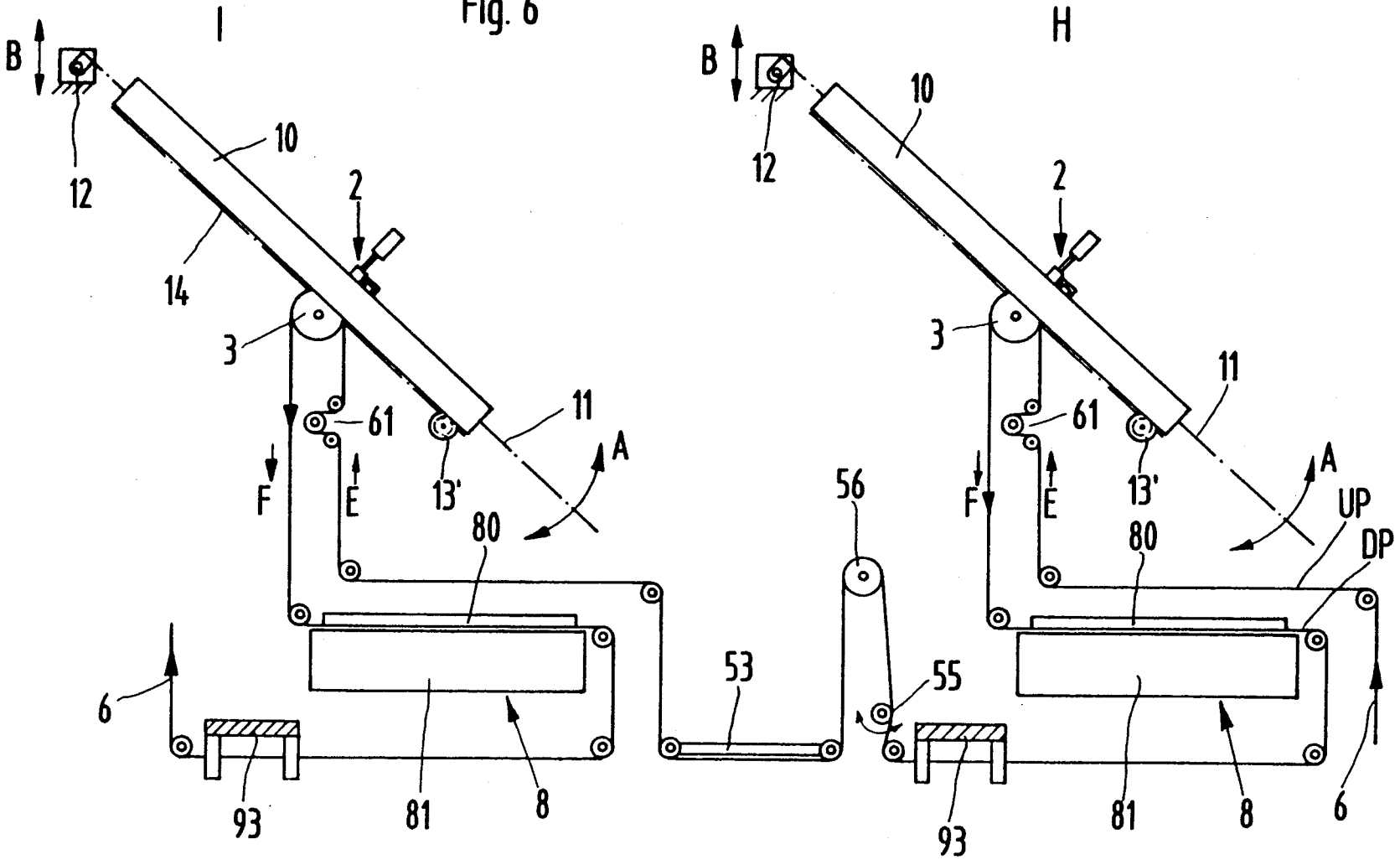
FIG. 6 is a partly side elevational and partly vertical sectional view of a screen printing machine with two units which are arranged in series.

FIG. 6 shows certain details of a machine with two screen printing units which are disposed in series at stations H, I and each of which can be identical with the screen unit of FIGS. 1-5. The screens of the two units can be reciprocated in synchronism, and the web 6 can be subjected to a drying action downstream of each of the two screen printing units. The stencils of the screens in the two units may but need not be identical, and the same holds true for the applicators 2 of these units. For example, at least one of the applicators 2 which are shown in FIG. 6 can comprise one or more spray nozzles which discharge sprays of atomized printing or other medium over the entire upper sides of successive increments of the web 6. The stencils of the two screens can have uniformly distributed apertures for the printing medium or at least one of the stencils can be designed to ensure the application of printing medium in accordance with a selected pattern. At least one of the stencils can constitute a so-called coarse stencil.

The web 6 is advanced stepwise so that it moves in the directions of arrows E and F when the cylinders 3 of the two screen printing units rotate in a counterclockwise direction. The construction of the cylinders 3 in the screen printing units of FIG. 6 may be identical with that of the web-supporting cylinders which are disclosed in commonly owned German Pats. Nos. 28 57 766 and 29 43 894. The printing stations H and I of FIG. 6 can be preceded or followed by one or more additional printing stations where the screen printing units may but need not be identical with that of FIGS. 1-5. It is preferred to intermittently rotate the cylinders 3 of all screen printing units in synchronism and through identical angles. The inclination of all screens 1 may but need not be the same; in fact, it might even be desirable to employ one or more screen printing units with inclined screens jointly with one or more screen printing units having non-inclined screens, for example, in a plant which owns one or more screen printing units with reciprocable horizontal screens.

In accordance with a further feature of the invention, the drying means 8 which are shown in FIG. 6 are disposed beneath the respective screens to further reduce the space requirements of the screen printing units. Each of the drying means 8 can comprise one or more dryers, and the two illustrated drying means 8 may but need not be of identical design. The provision of a drying means downstream of each screen printing unit renders it possible to introduce successive increments of the web 6 which leave the station H practically immediately into the printing station I to further reduce the space requirements of the screen printing machine. A drying means is preferred but not indispensable in screen printing machines with a single unit. A machine with several (e.g., four) screen printing units can be used with advantage for multicolor printing, and the space requirements of such machine can be reduced considerably by providing a drying means 8 or other suitable drying means downstream of each screen printing unit. For example, two screen printing units of a first type can alternate with two screen printing units of a different second type.

Each of the illustrated drying means 8 comprises a plate-like contact dryer 80 which is adjacent the uncoated side of the web 6 and can come in actual contact with the web, and a pneumatic dryer 81 which can comprise a hot air generator and one or more blowers, nozzles or other devices serving to direct streams or jets of hot air against the coated side of the web. A contact dryer is disclosed in the aforementioned commonly owned U.S. Pat. No. 4,628,620, and a modified dryer (which operates with ultraviolet light) is disclosed in the aforementioned commonly owned U.S. Pat. No. 4,619,050.

The path for the web 6 in the machine including the screen printing units of FIG. 6 comprises two inverted U-shaped portions, and each such path portion is preceded by a substantially horizontal upstream portion of section UP which merges into the upwardly extending leg (arrow E) of the respective inverted U-shaped portion, and a downstream portion or section DP which receives successive increments of the web 6 from the respective downwardly extending leg (arrow F) and is parallel to and overlapped by the respective portion UP. The drying means 8 are adjacent the downstream portions or sections DP, and these portions advance the web counter to the directions of advancement along the portions or sections UP. This contributes to compactness of the machine. The platforms 93 at the stations H and I serve the same purpose as the similarly referenced platform in the screen printing unit of FIGS. 1–5. The downstream portions DP are followed by path portions which extend beneath the respective platforms 93. An intermediate path portion between the inverted U-shaped portions is adjacent a web tensioning device 55, a pulley 56 and a web centering device 53 which may be identical with the tensioning device 53 of FIGS. 1 and 2. A person standing next to or occupying the right-hand platform 93 of FIG. 6 can observe the imprint or imprints on the increments of the web 6 which advance in the direction of arrow F as well as on the increments which advance from the tensioning device 55 toward the pulley 56.

FIG. 6 further shows two tension monitoring and regulating devices 61 acting upon and monitoring those increments of the web 6 which advance in directions indicated by the arrows E. The bights of the loops of the inverted U-shaped portions of the path for the web 6 are preferably configurated to ensure that the web contacts the cylinders 3 along arcs of exactly or approximately 180 degrees.

If the station I is the last station of two or more screen printing stations, the left-hand drying means 8 of FIG. 6 may be omitted. As mentioned above, the left-hand drying means 8 may but need not be identical with the right-hand drying means 8 of FIG. 6.

Figure 7:
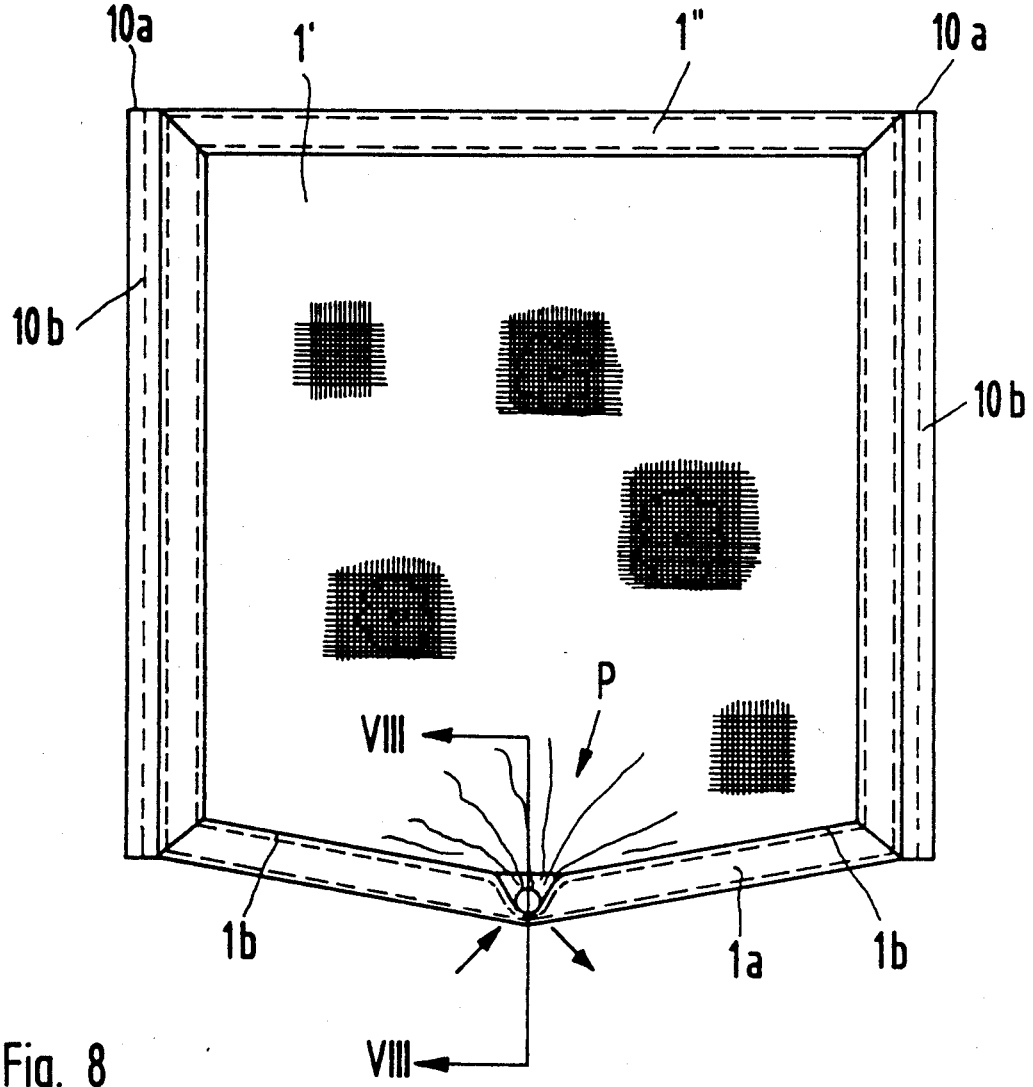
FIG. 7 is a plan view of a modified screen.
Figure 8:
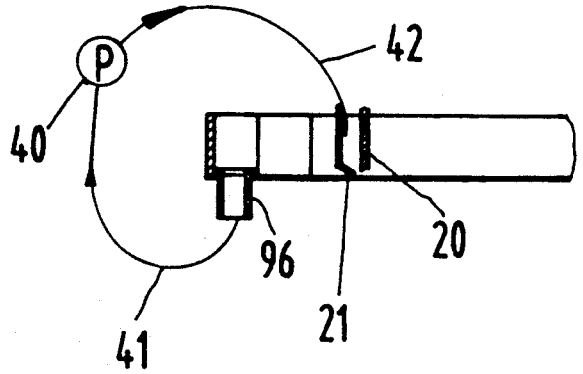
FIG. 8 is a fragmentary sectional view as seen in the direction of arrows from the line VIII—VIII in FIG. 7.

FIGS. 7 and 8 show a screen having a frame 1'' for a stencil 1' and guide rails **10*a* which are integral with or are otherwise suitably connected to the frame 1'' Thus, the carriage 10 of the screen printing unit of FIGS. 1–5 can be omitted and the grooves 10*b* of the guide rails 10*a* can cooperate with guide rails 11 (not shown in FIG. 7) on the frame of the machine which includes the screen of FIGS. 7 and 8**.

The lower portion **1*a* of the frame 1'' includes two mutually inclined sections 1*b* which together define a pocket P for the pool of printing medium next to the intake of the evacuating conduit 41. The latter is connected to a nipple 96 at the underside of the lower portion 1*a* of the frame 1'' (see FIG. 8). The conduit 42 of the applicator of FIG. 8 is a flexible hose which discharges recirculated printing medium between the squeegee 20 and the flood bar 21. The frame 1'' of the screen 1 which is shown in FIGS. 1–5 can be similar or identical to the frame 1'' of FIG. 7 (see FIG. 3). The pump 40** of the applicator which is, or which can be, used in the screen printing unit or units of the improved machine can be designed for circulation of highly viscous, low-viscosity or foamed media including adhesives, chemicals and/or others.

If desired, each screen can further include a lid or hood which overlies the lower portion of its frame 1'' to reduce the likelihood of contamination of the pool which gathers in the region of the sections **1*b* preparatory to evacuation by way of the conduit 41. The lid or hood (which is optional) is preferably detachable to facilitate inspection and/or cleaning (if and when necessary). Moreover, such lid or hood reduces the likelihood of splashing of printing medium in the region where it flows into the nipple 96. The sections lb of the lower frame portion la act not unlike ramps or barriers along which the contents of the pool flow toward and into the pocket P and thence into the nipple 96**. The illustrated sections lb make a relatively large obtuse angle.

FIG. 7 further shows that the stencil 1' of the screen can be provided with a plurality of identical or different patterns of apertures for the flow of printing medium into contact with the web.

An important advantage of the improved machine is that each of its screen printing units occupies little floor space and that the floor space requirements of the unit or units can be altered (if necessary) by changing the inclination of the respective screen or screens 1 relative to the horizontal plane a. Another advantage of the improved machine is that the operators can gain access to all or nearly all parts of each screen printing unit to thus ensure that any defects in the application of one or more printing or other media will be detected at an early stage so as to avoid the taking of long rejects. As described above, a person occupying or standing near a platform 93 can readily inspect those parts of the respective control unit which are not readily accessible in heretofore known screen printing units. Moreover, the drying means can be installed beneath the respective screen or screens, and each screen can be readily inspected from below, together with the associated web-supporting cylinder. That portion of the web which leaves a printing station is immediately accessible for inspection, and this preferably holds true for each and every printing station of the improved screen printing machine. The printing medium can be ink, another coloring agent, enamel, adhesive and/or any of many other media which can be applied to running webs of paper, metallic foil, plastic foil or textile material or to laminates containing two or more layers. The printing medium can substitute a readily flowing or a highly viscous substance or it can be a thermoplastic material which is solid at room temperatures so that it must be melted or at least heated to a higher temperature in order to be capable of flowing along and through the stencil or stencils of the screen or screens at one or more screen printing stations. Still further, the medium can constitute a substance which is hardenable at room temperature in response to the application of heat. For example, such thermoplastic and hardenable substances can be used for relief printing and can contain metallic particles (e.g., for the printing of computer- and other machine switches). As mentioned above, the printing medium can also contain or consist of a foamed substance and/or any one of a number of chemicals.

The improved screen can be provided with any one of a wide variety of stencils including those with uniformly distributed apertures as well as those with simple or complex patterns of apertures. The stencils can constitute fine or coarse sieves which ensure uniform distribution of printing medium over selected portions of or over the entire web.

As a rule, the improved machine will be used for the coating of elongated webs each of which is being paid out by a supply reel and is collected by one or more takeup reels. However, it is equally possible to convert the improved machine for the printing of individual sheets or sets of coherent sheets. If the machine is set up for the imprinting of elongated webs of paper, textile material or the like, it is preferably operated in a discontinuous manner, e.g., as disclosed in the aforementioned commonly owned German Offenlegungsschrift No. 29 43 894.

The webs or sheets which are to be treated in the improved machine can contain substrates of paper, cardboard, non-woven textile materials, other textile materials, fleece plastics and/or others. The textile materials can be woven, knit, machine knit, anchored or unanchored. At the present time, the machine is used primarily for the application of media to webs of paper or paper-like material.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A screen printing machine for the treatment of successive coherent sections of elongated webs which are advanced in a predetermined direction along a predetermined path, comprising a plurality of screen printing units including a first and a second printing unit, at least said first printing unit including a reciprocable flat screen at one side of a predetermined portion of said path; means for maintaining said screen in a plane which is inclined relative to the horizontal, including means for changing the inclination of the screen relative to the horizontal; first moving means for moving said screen relative to the horizontal; second moving means for moving said screen forwardly in and rearwardly counter to said predetermined direction; web supplying means including a web-supporting and advancing cylinder rotatable about a fixed axis and disposed at the other side of said portion of said path, at least said other side of said portion of said path being accessible; and applicator means including means for including the flow of a printing medium through said screen and into contact with the web in said portion of the path, a source of printing medium, means for conveying printing medium from said source to said screen, means for returning non-applied printing medium from said screen to said source, and means for maintaining said flow including means in a predetermined orientation with reference to said screen, said flow including means being located opposite said cylinder and said screen being located between said flow inducing means and said cylinder, said screen being movable relative to said cylinder and relative to said flow inducing means between an upper end position and a lower end position and said flow inducing means being operative during movement of said screen from the lower end position toward the upper end position, said second printing unit being adjacent a second portion of said path and one of said path portions being located upstream of the other of said path portions.

2. The machine of claim 1, wherein said second moving means includes a carriage for said screen.

3. The machine of claim 2, wherein said screen includes a stencil and a frame for said stencil, said frame being removably mounted in said carriage.

4. The machine of claim 2, wherein said second moving means further includes drive means for reciprocating said carriage relative to said cylinder at the one side of said path.

5. The machine of claim 1, wherein said screen is inclined to the horizontal at an angle of 5–85 degrees.

6. The machine of claim 5, wherein said angle is 50–70 degrees.

7. The machine of claim 6, wherein said angle equals or approximates 60 degrees.

8. The machine of claim 1, wherein said predetermined portion of said path forms a loop including a bight for said cylinder and two substantially vertical legs flanking said bight.

9. The machine of claim 8, wherein said unit further includes a platform adjacent one of said legs and extending substantially transversely of said path.

10. The machine of claim 1, wherein said first unit further includes a frame for said cylinder and said maintaining means includes at least one guide rail on said frame.

11. The machine of claim 10, further comprising means for adjustably affixing said guide rail to said frame.

12. The machine of claim 1, wherein said first unit further includes a frame for said cylinder and said maintaining means, said second moving means comprising at least one toothed rack arranged to move with said screen and a driven pinion mounted on said frame and mating with said rack.

13. The machine of claim 12, further comprising means for adjustably mounting said pinion in said frame.

14. The machine of claim 1, wherein said units are spaced apart in said direction to provide room for inspection intermediate said units.

15. The machine of claim 1, further comprising means for changing the inclination of screens relative to the horizontal in each of said units.

16. The machine of claim 1, wherein said flow inducing means comprises a squeegee and a flood bar beneath said squeegee, said source including a pump having an inlet and an outlet and said conveying means including means for supplying printing medium from said outlet to said screen intermediate said squeegee and said flood bar, said returning means including means for conveying non-applied printing medium from said screen to said inlet.

17. A screen printing machine for the treatment of successive coherent sections of elongated webs which are advanced in a predetermined direction along a predetermined path, comprising a plurality of screen printing units including a first and a second printing unit, at least said first printing unit including a reciprocable flat screen at one side of a predetermined portion of said path; means for maintaining said screen in a plane which is inclined relative to the horizontal, including means for changing the inclination of the screen relative to the horizontal; means for moving said screen forwardly in and rearwardly counter to said direction; web supplying means including a web-supporting and advancing cylinder rotatable about a fixed axis and disposed at the other side of said portion of said path, at least said other side of said portion of said path being accessible; and applicator means including means for inducing the flow of a printing medium through said screen and into contact with the web in said portion of said path, said flow inducing means including a squeegee adjacent said screen in the region o said cylinder and said applicator means further comprising a pump having an inlet and an outlet for the printing medium, first conduit means for conveying printing medium from said outlet to the screen in the region of said squeegee so that the squeegee can apply some of the thus received medium from the web through said screen in response to movement of the screen, flexible second conduit means for conveying non-applied printing medium from said screen to said inlet, and means for maintaining said flow inducing means in a predetermined orientation with reference to said screen, said second printing unit being adjacent a second portion of said path and one of said path portions being located upstream of the other of said path portions.

18. The machine of claim 17, wherein said screen has an upper portion and a lower portion and said second conduit means has an intake for non-applied printing medium in the region of said lower portion.

19. The machine of claim 17, wherein said applicator means further comprises a flood bar beneath said squeegee, said first conduit means including means for supplying printing medium from said outlet to said screen intermediate said squeegee and said flood bar.

20. A screen printing machine for the treatment of webs which are advanced in a predetermined direction along a predetermined path, comprising a plurality of screen printing units including a first and a second printing unit, at least said first printing unit including a reciprocable flat screen at one side of a predetermined portion of said path, said screen including a stencil and a frame surrounding said stencil; means for maintaining said screen in a plane which is inclined relative to the horizontal, including means for changing the inclination of the screen relative to the horizontal; first moving means for moving said screen relative to the horizontal; second moving means for moving said screen forwardly in and rearwardly counter to said predetermined direction; web supplying means including a web-supporting and advancing cylinder rotatable about a fixed axis and disposed at the other side of said portion of said path, at least said other side of said portion of said path being accessible; and applicator means including means for inducing the flow of printing medium through said screen and into contact with the web in said portion of the path, a source of printing medium, means for conveying printing medium from said source to said screen, means for returning non-applied printing medium from said screen to said source, and means for maintaining said flow inducing means in a predetermined orientation with reference to said screen, said flow inducing means being located opposite said cylinder and said screen being located between said flow inducing means and said cylinder, said screen being movable relative to said cylinder and relative to said flow inducing means between an upper end position and a lower end position and said flow inducing means being operative during movement of said screen from the lower end portion toward the upper end position, said second printing unit being adjacent a second portion of said path and one of said path portions being located upstream of the other of said path portions, said frame including an upper portion and a lower portion and said lower portion having a plurality of sections which are inclined relative to each other and define a pocket for collection of non-applied printing medium.

21. The machine of claim 20, wherein said returning means has an intake in the region of said pocket.

22. A screen printing machine for the treatment of webs which are advanced in a predetermined direction along a predetermined path, comprising a plurality of screen printing units including a first and a second printing unit, at least said first printing unit including a reciprocable flat screen at one side of a predetermined portion of said path; means for maintaining said screen in a plane which is inclined relative to the horizontal, including means for changing the inclination of the screen relative to the horizontal; first moving means for moving said screen relative to the horizontal; second moving means for moving said screen forwardly in and rearwardly counter to said predetermined direction; web supplying means including a web-supporting and advancing cylinder rotatable about a fixed axis and disposed at the other side of said predetermined portion of said path, at least said other side of said predetermined portion of said path being accessible and being substantially U-shaped with a bight for said cylinder and with two legs flanking said cylinder, the web being arranged to move upwardly along one of said legs and downwardly along the other of said legs, said path further including an upstream portion along which the web advances toward said one leg and a downstream portion along which the web advances from said other leg, one of said upstream and downstream portions overlapping the other of said upstream and downstream portions; and applicator means including means for inducing the flow of a printing medium through said screen and into contact with the web in said predetermined portion of the path, a source of printing medium, means for conveying printing medium from said source to said screen, means for returning non-applied printing medium from said screen to said source, and means for maintaining said flow inducing means in a predetermined orientation with reference to said screen, said flow inducing means being located opposite said cylinder and said screen being located between said flow inducing means and said cylinder, said screen being movable relative to said cylinder and relative to said flow inducing means between an upper end position and a lower end position and said flow inducing means being operative during movement of said screen from the lower end position toward the upper end position, said second printing unit being adjacent a further portion of said path and one of said predetermined and further path portions being located upstream of the other of said predetermined and further path portions.

* * * * *